US011335525B2

(12) United States Patent
Fujiwara et al.

(10) Patent No.: US 11,335,525 B2
(45) Date of Patent: May 17, 2022

(54) ELECTROMAGNETIC RELAY

(71) Applicant: DENSO ELECTRONICS CORPORATION, Anjo (JP)

(72) Inventors: Mitsugu Fujiwara, Anjo (JP); Makoto Kamiya, Anjo (JP)

(73) Assignee: DENSO ELECTRONICS CORPORATION, Anjo (JP)

( * ) Notice: Subject to any disclaimer, the term of this patent is extended or adjusted under 35 U.S.C. 154(b) by 271 days.

(21) Appl. No.: 16/427,795

(22) Filed: May 31, 2019

(65) Prior Publication Data

US 2019/0287748 A1 Sep. 19, 2019

Related U.S. Application Data

(63) Continuation of application No. PCT/JP2017/032753, filed on Sep. 12, 2017.

(30) Foreign Application Priority Data

Dec. 21, 2016 (JP) ..... JP2016-248078

(51) Int. Cl.

| | |
|---|---|
| ***H01H 9/00*** | (2006.01) |
| ***H01H 50/20*** | (2006.01) |
| ***H01H 50/36*** | (2006.01) |
| ***H01H 50/00*** | (2006.01) |
| ***H01H 50/34*** | (2006.01) |

(52) U.S. Cl.

CPC ..... *H01H 50/20* (2013.01); *H01H 50/00* (2013.01); *H01H 50/34* (2013.01); *H01H 50/36* (2013.01)

(58) Field of Classification Search

CPC ..... H01H 50/20; H01H 50/00; H01H 50/34; H01H 50/36; H01H 50/32; H01H 50/163

USPC ..... 335/180

See application file for complete search history.

(56) References Cited

U.S. PATENT DOCUMENTS

| | | | | |
|---|---|---|---|---|
| 2010/0289604 | A1* | 11/2010 | Kojima | H02H 9/001 335/133 |
| 2016/0225565 | A1* | 8/2016 | Sugisawa | H01H 50/56 |
| 2016/0300676 | A1* | 10/2016 | Sakai | H01H 50/546 |
| 2016/0314917 | A1* | 10/2016 | Park | H01H 33/74 |
| 2017/0301497 | A1* | 10/2017 | Tanaka | H01H 50/14 |

(Continued)

FOREIGN PATENT DOCUMENTS

| | | | |
|---|---|---|---|
| JP | 2011054405 | A | 3/2011 |
| JP | 2014099319 | A | 5/2014 |
| JP | 2015084315 | A | 4/2015 |

*Primary Examiner* — Shawki S Ismail

*Assistant Examiner* — Lisa N Homza

(74) *Attorney, Agent, or Firm* — Harness, Dickey & Pierce, P.L.C.

(57) ABSTRACT

An electromagnetic relay includes: a coil; a housing that supports the coil; a non-movable portion supported by the housing and including a fixed core and a fixed magnetic path defining member; and a movable portion provided to be reciprocally movable along a center axis line of the coil according to an energization state of the coil. The movable portion includes a movable core disposed to face the fixed core along the center axis line. The movable portion integrally has a flange portion protruding in a coil radial direction perpendicular to the center axis line to define a separation distance and/or a facing area in a magnetic gap between the fixed magnetic path defining member and the movable core by abutting against the non-movable portion.

11 Claims, 7 Drawing Sheets

(56) References Cited

U.S. PATENT DOCUMENTS

| | | | | |
|---|---|---|---|---|
| 2017/0365431 | A1* | 12/2017 | Sakai | H01H 50/44 |
| 2018/0061544 | A1* | 3/2018 | Tanaka | H01F 7/1653 |
| 2018/0350542 | A1* | 12/2018 | Tanaka | H01H 50/02 |
| 2019/0221392 | A1* | 7/2019 | Nishiguchi | H01H 50/443 |
| 2019/0287748 | A1* | 9/2019 | Fujiwara | H01H 50/34 |
| 2019/0304726 | A1* | 10/2019 | Ishikawa | H01H 50/18 |
| 2020/0273650 | A1* | 8/2020 | Tanaka | H01H 50/30 |
| 2020/0350134 | A1* | 11/2020 | Ishikawa | H01H 50/54 |
| 2021/0082647 | A1* | 3/2021 | Harimochi | H01H 50/20 |
| 2021/0202198 | A1* | 7/2021 | Hayashida | H01H 1/20 |

* cited by examiner

ELECTROMAGNETIC RELAY

CROSS REFERENCE TO RELATED APPLICATIONS

The present application is a continuation application of International Patent Application No. PCT/JP2017/032753 filed on Sep. 12, 2017, which designated the United States and claims the benefit of priority from Japanese Patent Application No. 2016-248078 filed on Dec. 21, 2016. The entire disclosures of all of the above applications are incorporated herein by reference.

TECHNICAL FIELD

The present disclosure relates to an electromagnetic relay.

BACKGROUND ART

An electromagnetic relay includes a coil, a housing, a non-movable portion, and a movable portion provided to be reciprocally movable along a center axis line of the coil according to an energization state of the coil.

SUMMARY

According to the present disclosure, an electromagnetic relay includes:

a coil disposed to develop a magnetic field by energization;

a housing that supports the coil to fix;

a non-movable portion supported by the housing to fix, the non-movable portion including at least one fixed magnetic path defining member, to define a fixed magnetic path during the energization of the coil, having a fixed core disposed inside the coil; and a movable portion provided to be reciprocally movable along a center axis line of the coil according to an energization state of the coil, the movable portion including a movable core disposed to face the fixed core along the center axis line to be attracted by the fixed core by the magnetic field during the energization of the coil.

In the electromagnetic relay, one of a plurality of members configuring the movable portion integrally has a flange portion protruding in a coil radial direction perpendicular to the center axis line to define a separation distance and/or a facing area in a magnetic gap between the fixed magnetic path defining member and the movable core by abutting against the non-movable portion during the energization.

DESCRIPTION OF EMBODIMENTS

Figure 1:
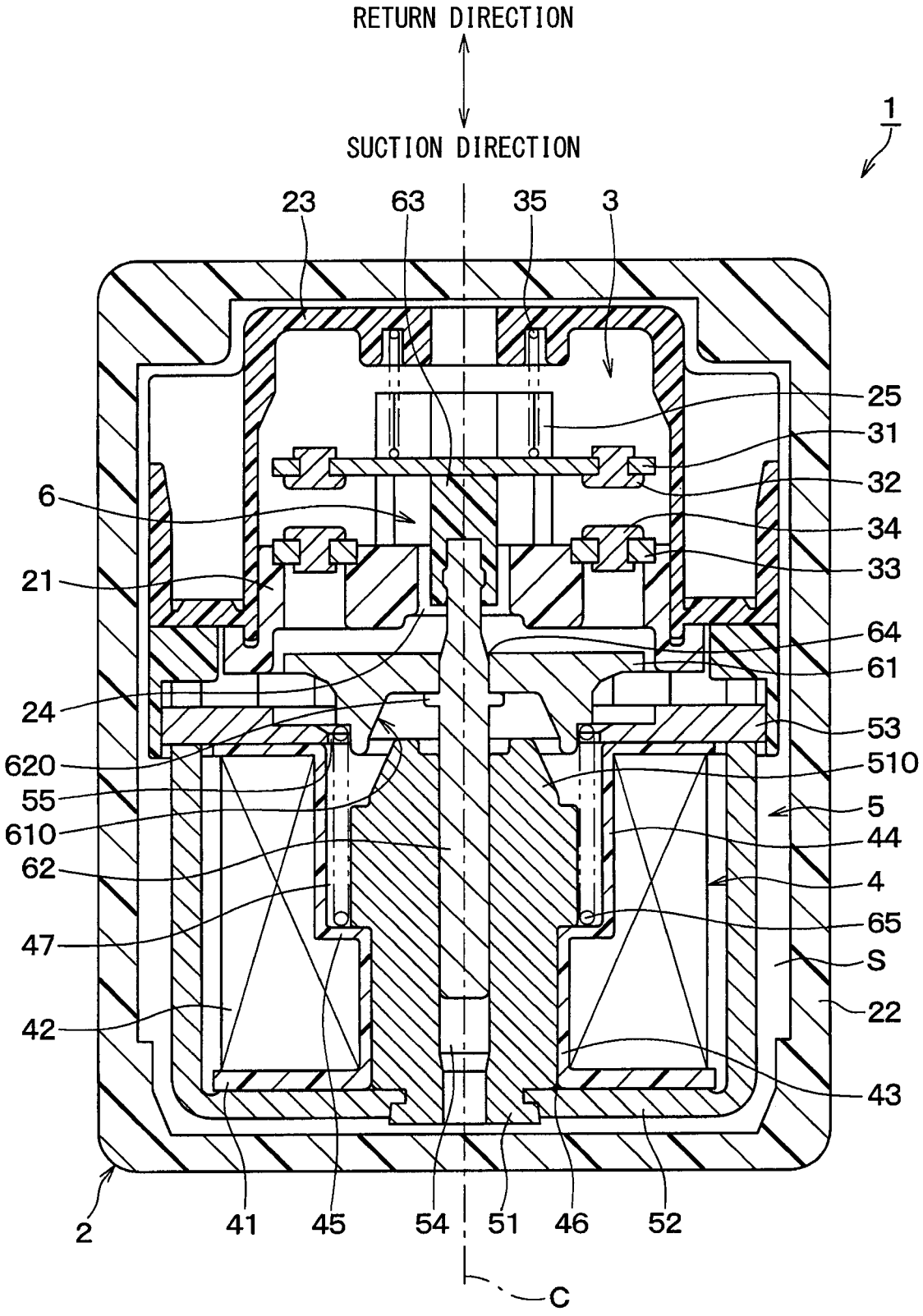
FIG. 1 is a schematic sectional view according to a first embodiment.

Hereinafter, embodiments of the present disclosure will be described according to the drawings. A variety of modifications applicable to the embodiments will be described after the description of the embodiments as modified examples.

First Embodiment

First, a schematic configuration of an electromagnetic relay 1 according to a first embodiment will be described with reference to FIG. 1. The electromagnetic relay 1 includes a housing 2, a contact mechanism 3, a coil 4, a non-movable portion 5, and a movable portion 6.

In FIG. 1, one of the directions parallel to the center axis line C of the coil 4 (that is, a lower side in FIG. 1) is referred to as "suction direction", and the other (that is, an upper side in FIG. 1) is referred to as "return direction". In addition, in an arbitrary plane perpendicular to the center axis line C, a direction away from the center axis line C so as to extend radially from the center axis line C is referred to as a "coil radial direction". In other words, the coil radial direction is an arbitrary linear direction perpendicular to the center axis line C and passing through the center axis line C. The definitions of those directions are the same for FIG. 2 and subsequent figures.

The housing 2 made of synthetic resin includes a base frame 21, an outer cover 22, and a contact cover 23. The base frame 21 supports the contact mechanism 3, the coil 4, the non-movable portion 5, and the movable portion 6. FIG. 1 mainly shows a portion of the base frame 21 supporting the contact mechanism 3. However, the base frame 21 is provided with the coil 4, the non-movable portion 5, and a bottom plate portion (not shown) for supporting the movable portion 6.

The outer cover 22 is formed in a bathtub shape having an opening on one surface in a rectangular parallelepiped shape. The opening is provided so as to open toward a side perpendicular to the center axis line C (that is, a direction perpendicular to the plane of paper in FIG. 1). The outer cover 22 is formed so as to cover the contact mechanism 3, the coil 4, the non-movable portion 5, and the movable portion 6 supported by the base frame 21 from the outside. In other words, the housing 2 is configured to form an accommodation space S inside by closing the opening in the outer cover 22 with the bottom plate portion in the base frame 21. The configurations of the base frame 21 and the outer cover 22 are the same as those of a fifth embodiment shown in FIG. 6.

The contact cover 23 is disposed between the outer cover 22 and the contact mechanism 3. Specifically, the contact cover 23 is formed in an inverted U shape that opens in the suction direction so as to cover the contact mechanism 3 from the upper side in the figure.

The illustrated portion of the base frame 21 supporting the contact mechanism 3 has a shaft insertion hole 24, which is a through hole defined along the center axis line C. The base frame 21 is provided with a guide portion 25. The guide portion 25 protrudes in the return direction so as to guide a reciprocating movement of the movable piece 31 provided in the contact mechanism 3 along the center axis line C.

In addition to the movable piece 31 described above, the contact mechanism 3 includes a movable contact 32, a fixed piece 33, a fixed contact 34, and a contact pressure spring 35. The movable piece 31 is formed of a plate-like member made of metal, and is provided on the return direction side of the fixed piece 33 in such a posture that a main surface of the movable piece 31 is perpendicular to the center axis line C. The movable contact 32 is formed of an electric contact member made of metal, and is fixed to the movable piece 31 by caulking or the like.

The fixed piece 33 is formed of a plate-like member made of metal, and is fixed to the base frame 21 in such a posture that the main surface of the fixed piece 33 is perpendicular to the center axis line C. The fixed contact 34 is formed of an electric contact member made of metal, and is disposed to face the movable contact 32 along the center axis line C. The fixed contact 34 is fixed to the fixed piece 33 by caulking or the like. The contact pressure spring 35 is a coil spring, and is provided between the movable piece 31 and the contact cover 23 so as to urge the movable piece 31 toward the fixed piece 33 in the suction direction.

The coil 4 is fixedly supported by the base frame 21 while being disposed on the suction direction side of the contact mechanism 3. The coil 4 includes a bobbin 41 and a winding 42. A winding 42 is wound around the bobbin 41 made of synthetic resin. In other words, the coil 4 is configured to form a magnetic field by energizing the winding 42.

The bobbin 41 has a first bobbin cylinder portion 43, a second bobbin cylinder portion 44, and a step portion 45. The first bobbin cylinder portion 43 is provided closer to the suction direction side than the second bobbin cylinder portion 44. The second bobbin cylinder portion 44 is formed to have an inner diameter larger than that of the first bobbin cylinder portion 43. The step portion 45 is provided at a connection portion between the first bobbin cylinder portion 43 and the second bobbin cylinder portion 44.

A core installing hole 46 is provided inside the first bobbin cylinder portion 43. A spring accommodation hole 47 is provided inside the second bobbin cylinder portion 44. The core installing hole 46 is provided so as to be in close contact with the fixed core 51 when the fixed core 51 in the non-movable portion 5 is inserted through the core installing hole 46. The spring accommodation hole 47 is provided to create a predetermined space between the fixed core 51 and the spring accommodation hole 47 when the fixed core 51 in the non-movable portion 5 is inserted through the spring accommodation hole 47.

The fixed core 51 is a substantially columnar member formed seamlessly and integrally, and is disposed inside the coil 4. Specifically, the fixed core 51 is fixedly attached to the coil 4 (that is, so as not to move relative to the coil 4 along the center axis line C regardless of the energized state of the coil 4) by being inserted through the core installing hole 46 and the spring accommodation hole 47 provided in the bobbin 41.

The non-movable portion 5 includes a frame yoke 52 and a plate yoke 53 in addition to the fixed core 51. The fixed core 51, the frame yoke 52, and the plate yoke 53 are fixed magnetic path defining members made of a ferromagnetic metal material, and are provided so as to form a fixed magnetic path by energization of the coil 4. The non-movable portion 5 is fixedly supported by the base frame 21 (that is, so as not to move relative to the base frame 21 along the center axis line C regardless of the energized state of the coil 4).

The frame yoke 52 is a member having a shape in which a flat plate is bent into a substantially U-shape, and is disposed so that the substantially U-shape is opened toward the return direction. An end portion of the fixed core 51 in the suction direction is coupled to a bottom plate portion of the frame yoke 52, the main surface of which is perpendicular to the center axis line C.

The plate yoke 53 is a flat plate-like member formed seamlessly and integrally, and is provided so that a main surface of the plate yoke 53 is perpendicular to the center axis line C. The plate yoke 53 is disposed adjacent to the frame yoke 52 such that an outer edge portion of the plate yoke 53 abuts against both end portions of the frame yoke 52 protruding toward the return direction.

The fixed core 51 has a guide hole 54. The guide hole 54 is a through hole and is provided on the center axis line C coaxial with the axial center of the fixed core 51. The plate yoke 53 has a core passage hole 55. The core passage hole 55 is provided so as to pass through the plate yoke 53 along the center axis line C. The core passage hole 55 is provided in the center portion of the plate yoke 53 so that a portion of the movable core 61 in the movable portion 6 can pass through the core passage hole 55 when the movable core 61 reciprocates along the center axis line C.

The movable portion 6 is provided so as to be able to reciprocate along the center axis line C in accordance with the energized state of the coil 4. Specifically, the movable portion 6 includes a shaft 62 and an insulator 63 in addition to the movable core 61.

The movable core 61 is a substantially disk-shaped member made of a ferromagnetic metal material, and is formed seamlessly and integrally. The movable core 61 is disposed between the contact mechanism 3 and the non-movable portion 5. The movable core 61 is disposed to face the fixed core 51 and the plate yoke 53 along the center axis line C so as to be attracted to the fixed core 51 and the plate yoke 53 by a magnetic field at the time of energization of the coil 4. Specifically, the plate yoke 53 is disposed between the movable core 61 and the fixed core 51.

The shaft 62 is a rod-shaped member having a longitudinal direction parallel to the center axis line C, and is formed seamlessly and integrally. In other words, the shaft 62 is provided along the center axis line C. The shaft 62 is inserted through a shaft fixing hole 64 provided in the movable core 61 and fixed to the movable core 61.

An end portion of the shaft 62 in the return direction is covered with an insulator 63 made of synthetic resin. An end portion of the shaft 62 in the return direction covered by the insulator 63 is disposed to face the movable piece 31 while being inserted through the shaft insertion hole 24. The portion of the shaft 62 on the suction direction side is housed in the guide hole 54 provided in the fixed core 51 while being guided by the guide hole 54 provided in the fixed core 51 so as to be reciprocally movable along the center axis line C.

A return spring 65, which is a coil spring, is disposed on the suction direction side of the movable core 61. The return spring 65 is housed in the space between the fixed core 51 and the second bobbin cylinder portion 44 formed in the spring accommodation hole 47. The return spring 65 is provided to urge the movable core 61 in the return direction.

Next, a detailed configuration of the electromagnetic relay 1 according to the present embodiment will be described with reference to FIGS. 1 and 2.

In the present embodiment, a male tapered portion 510 is provided at an end portion of the fixed core 51 that is close to and opposed to the movable core 61 during the energization of the coil 4, that is, at an end portion in the return direction. The male tapered portion 510 is formed in a substantially truncated cone shape so as to project toward the return direction. The male tapered portion 510 has a core top surface 511, a tapered outer surface 512, a step surface 513, and a fixed side recess portion 514.

The core top surface 511 is a plane formed in a ring shape so as to surround the shaft 62, and is provided so that the normal direction is parallel to the center axis line C. The tapered outer surface 512 is a tapered surface corresponding to a side surface in a substantially truncated cone shape of the male tapered portion 510, and is formed so as to increase in diameter from an outer edge of the core top surface 511 toward the suction direction.

The step surface 513 is a ring-shaped plane formed so that the normal direction is parallel to the center axis line C, and extends from the end portion of the tapered outer surface 512 on the suction direction side toward the coil radial direction. The fixed side recess portion 514 is a recess portion that opens toward the return direction, and is provided adjacent to the center axis line C of the core top surface 511. In other words, the core top surface 511 is provided on the outer side of the fixed side recess portion 514 in the coil radial direction.

The fixed side recess portion 514 is formed by a recess portion side surface 515 and a recess portion bottom surface 516. The recess portion side surface 515 is a cylindrical inner surface parallel to the center axis line C and extends from the inner edge portion of the core top surface 511 toward the suction direction. The recess portion bottom surface 516 is a flat surface formed in a ring shape so as to surround the shaft 62, and extends from an end portion of the recess portion side surface 515 on the suction direction side toward the center axis line C. The recess portion bottom surface 516 is formed in parallel with the core top surface 511 with a normal direction parallel to the center axis line C. In other words, the recess portion bottom surface 516 is provided at a position offset from the core top surface 511 in the suction direction by a height of the recess portion side surface 515.

The plate yoke 53 has a yoke recess portion 531. The yoke recess portion 531 is a recess portion that opens toward the return direction, and is provided around the core passage hole 55. In other words, at a position of the plate yoke 53 corresponding to the yoke recess portion 531, a thin portion 532 having a thinner plate thickness than that of the outside of the yoke recess portion 531 is formed. A yoke surface 533 of the thin portion 532, which is a surface exposed in the return direction, is provided to oppose the plate yoke 53 to form a first magnetic gap G1 between the movable core 61 and the plate yoke 53.

The movable core 61 is provided with a female tapered portion 610 that configures a recess portion that opens toward the suction direction. The female tapered portion 610 is formed to be able to house the male tapered portion 510 of the fixed core 51 when the coil 4 is energized. Specifically, the movable core 61 includes a center plate portion 611, a cylindrical portion 612, and a core flange portion 613.

The center plate portion 611 is a substantially disk-shaped portion adjacent to the shaft 62 in the coil radial direction, and has a shaft fixing hole 64. The cylindrical portion 612 is a cylinder portion provided so as to surround the male tapered portion 510 of the fixed core 51 from the outside, and protrudes from the outer edge portion of the center plate portion 611 toward the suction direction. In other words, the center plate portion 611 and the cylindrical portion 612 configure the female tapered portion 610. The core flange portion 613 is a thin portion thinner in plate thickness than the center plate portion 611, and extends in the coil radial direction from the outer edge portion of the center plate portion 611.

A surface of the movable core 61 exposed in the suction direction has a flange abutment surface 614, a tapered inner surface 615, a protrusion surface 616, and a core flange surface 617. The flange abutment surface 614 is a plane forming a bottom surface of the recess portion formed by the center plate portion 611 and the cylindrical portion 612, and is formed in a ring shape so as to surround the shaft 62. The flange abutment surface 614 is provided so as to face the core top surface 511. The tapered inner surface 615 is provided so as to face the tapered outer surface 512 at a substantially constant interval. The protrusion surface 616 is an end face of the cylindrical portion 612 in the suction direction, and is provided so as to face the step surface 513. The core flange surface 617 is provided on the core flange portion 613 so as to face the yoke surface 533.

The shaft 62 has a shaft flange portion 620 protruding in the coil radial direction. The shaft flange portion 620 is provided at a position adjacent to a portion of the shaft 62 fixed to the shaft fixing hole 64 on the suction direction side. As shown in FIG. 2, when the movable core 61 is attracted to the fixed core 51 by the magnetic field during the energization of the coil 4, the shaft flange portion 620 is formed so as to be housed in and abut against the fixed side recess portion 514 of the fixed core 51.

The shaft flange portion 620 is formed to have a substantially constant thickness (a dimension in a direction parallel to the center axis line C). The shaft flange portion 620 has a first flange surface 621 and a second flange surface 622. The first flange surface 621 and the second flange surface 622 are planes whose normal direction is parallel to the center axis line C, and are formed in a ring shape so as to surround the center axis line C.

The first flange surface 621 is provided so as to face the movable core 61. More specifically, the first flange surface 621 is formed so as to abut against (that is, in close contact with) the flange abutment surface 614 of the center plate portion 611 in a state where the movable core 61 is fixed to the shaft 62.

The second flange surface 622 is formed on the back side of the first flange surface 621 so as to face the recess portion bottom surface 516. The second flange surface 622 is provided so as to be separated from the recess portion bottom surface 516 when the coil 4 is not energized, and to abut against the concave bottom surface 516 when the movable core 61 is attracted to the fixed core 51 by the magnetic field when the coil 4 is energized.

Figure 2:
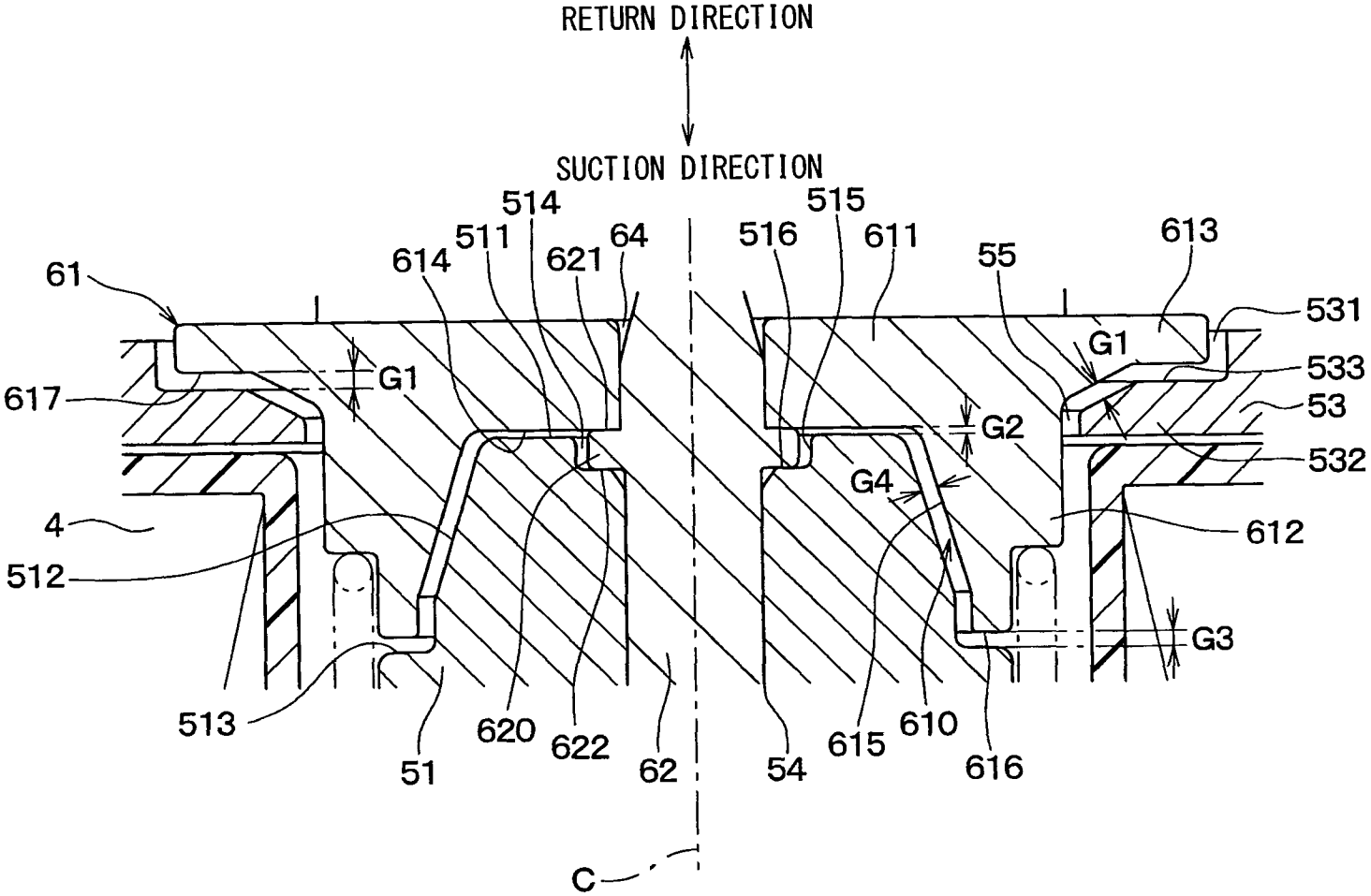
FIG. 2 is an enlarged view illustrating a part of FIG. 1.

As shown in FIG. 2, in the present embodiment, a first magnetic gap G1 is defined between the yoke surface 533 of the plate yoke 53 and the core flange surface 617 of the movable core 61. A second magnetic gap G2 is defined between the core top surface 511 of the fixed core 51 and the flange abutment surface 614 of the movable core 61. A third magnetic gap G3 is defined between the step surface 513 of the fixed core 51 and the protrusion surface 616 of the movable core 61. A fourth magnetic gap G4 is defined between the tapered outer surface 512 of the fixed core 51 and the tapered inner surface 615 of the movable core 61.

The shaft flange portion 620 is provided to define the separation distances and/or facing areas in those magnetic gaps. Specifically, the separation distances in the first to fourth magnetic gaps G1 to G4 are defined by the thickness of the shaft flange portion 620 and the depth of the fixed side recess portion 514 in the fixed core 51. The thickness of the shaft flange portion 620 corresponds to a distance between the first flange surface 621 and the second flange surface 622 in the suction direction. The depth of the fixed side recess portion 514 corresponds to a distance between the core top surface 511 and the recess portion bottom surface 516 in the suction direction.

The facing area of the second magnetic gap G2 is an area where the core top surface 511 of the fixed core 51 and the flange abutment surface 614 of the movable core 61 face each other. That area is defined by the outer diameter of the shaft flange portion 620, that is, the dimension in the coil radial direction in the fixed side recess portion 514 for housing the shaft flange portion 620.

Hereinafter, the operation and effects of the configuration of the present embodiment will be described. As apparent from the above description, FIG. 1 shows a state in which the coil 4 is not energized, and FIG. 2 shows a state in which the coil 4 is energized.

In the electromagnetic relay 1 according to the present embodiment, the movable core 61 is attracted to the fixed core 51 by the magnetic field at the time of energization of the coil 4. As a result, the movable portion 6 including the movable core 61 moves along the center axis line C toward the non-movable portion 5 including the fixed core 51.

At that time, the shaft flange portion 620 integrally provided with the shaft 62, which is one of multiple members configuring the movable portion 6, abuts against the non-movable portion 5. As a result, the separation distances and/or the facing areas in the first to fourth magnetic gaps G1 to G4 between the fixed core 51 and the plate yoke 53, which are fixed magnetic path defining members, and the movable core 61 are defined.

For example, the thickness of the shaft flange portion 620 is set to be thick, thereby being capable of increasing the separation distances in the first magnetic gap G1 and the fourth magnetic gap G4. On the other hand, for example the depth of the fixed side recess portion 514 in the fixed core 51 is set to be deep, thereby being capable of reducing the separation distances in the first to fourth magnetic gaps G1 to G4 without setting the shaft flange portion 620 to be too thin. In addition, the diameters of the shaft flange portion 620 and the fixed side recess portion 514 are increased, thereby being capable of reducing the facing area in the second magnetic gap G2.

As described above, according to the electromagnetic relay 1 of the present embodiment, the adjustment of the separation distances and/or the facing areas in the first to fourth magnetic gaps G1 to G4 can be performed more excellently. In other words, the shape of the shaft flange portion 620 and the shape of the fixed side recess portion 514 corresponding to the shape of the shaft flange portion 620 are arbitrarily set, thereby being capable of arbitrarily adjusting the separation distances in the first to fourth magnetic gaps G1 to G4 and the facing area in the second magnetic gap G2. Therefore, according to the present embodiment, the operation voltage in the electromagnetic relay 1 can be easily adjusted. In addition, the degree of freedom in design of the electromagnetic relay 1 is improved.

In the electromagnetic relay 1 according to the present embodiment, the shaft 62 including the shaft flange portion 620 for defining the first to fourth magnetic gaps G1 to G4 is formed seamlessly and integrally. In the configuration described above, the shaft flange portion 620 formed seamlessly and integrally with the shaft 62, which is one of the multiple members configuring the movable portion 6, abuts against the member (that is, the fixed core 51) configuring the non-movable portion 5, thereby defining the separation distances and/or the facing areas in the first to fourth magnetic gaps G1 to G4. Therefore, according to the configuration described above, the separation distances in the first to fourth magnetic gaps G1 to G4 can be set with more excellent accuracy.

Second Embodiment

Hereinafter, another embodiment in which a part of the embodiment described above is modified will be described. In the following description of the second embodiment and the like, only portions different from the first embodiment will be described. In the first embodiment, the second embodiment, and the like, the same or equivalent parts are denoted by the same reference numerals. Therefore, in the following description of the second embodiment and the like, the description of the first embodiment can be appropriately incorporated as to the components having the same reference numerals as those of the first embodiment, unless there is a technical contradiction or a special additional description.

Figure 3:
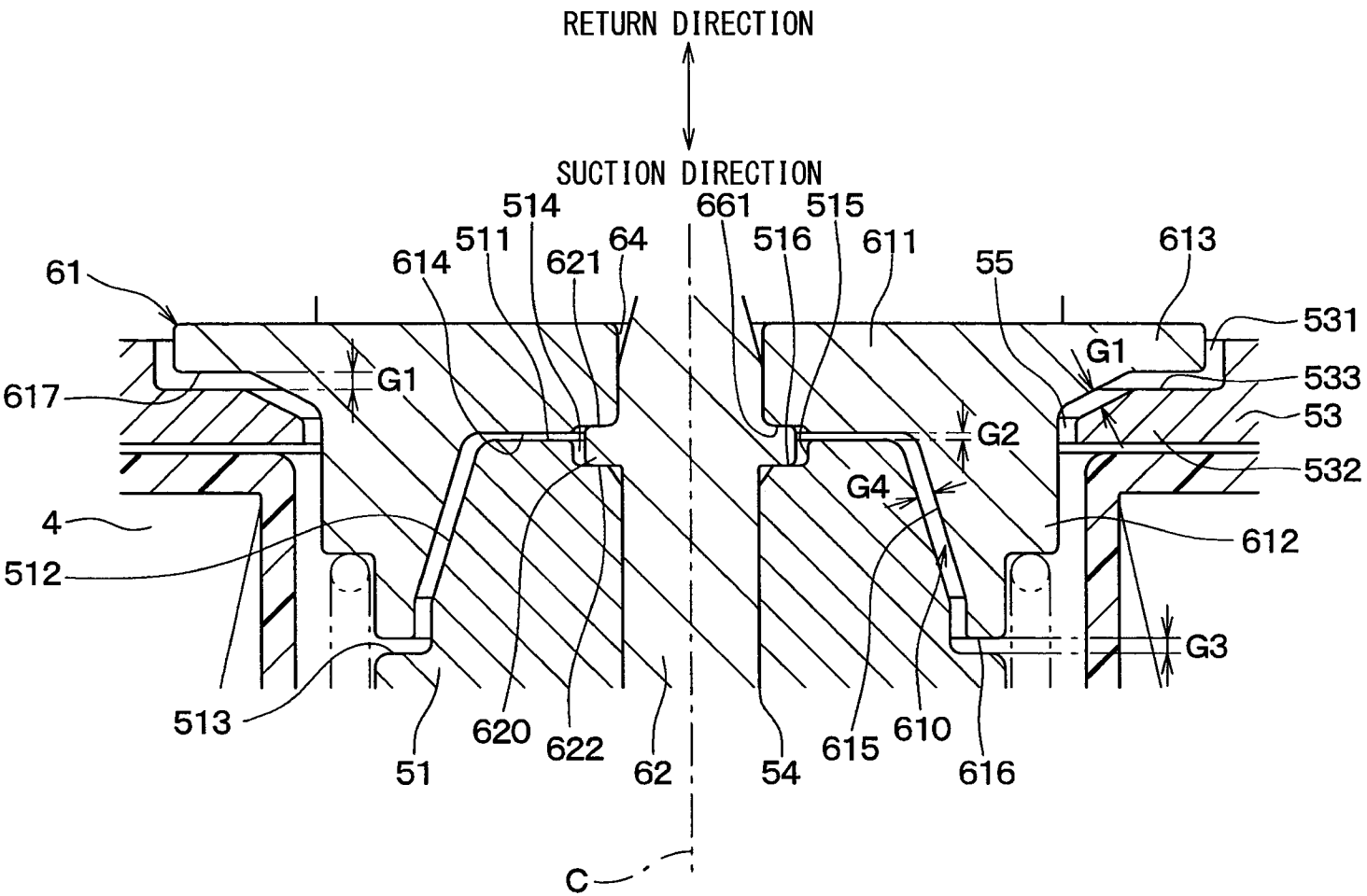
FIG. 3 is a schematic sectional view according to a second embodiment.

As shown in FIG. 3, the movable core 61 may have a movable side recess portion 661 that opens toward the shaft flange portion 620. In that case, a shaft 62 is fixed to the movable core 61 in a state in which the shaft flange portion 620 is housed in the movable side recess portion 661.

In the configuration described above, the separation distances in the first to fourth magnetic gaps G1 to G4 are defined by a thickness of the shaft flange portion 620, a depth of a fixed side recess portion 514 in the fixed core 51, and a depth of the movable side recess portion 661 in the movable core 61. The facing area in the second magnetic gap G2 is defined by the outer diameter of the shaft flange portion 620, that is, the dimensions in the coil radial direction of the fixed side recess portion 514 and the movable side recess portion 661 for housing the shaft flange portion 620. Therefore, the same effects as those of the first embodiment can be achieved by the configuration described above.

Third Embodiment

Figure 4:
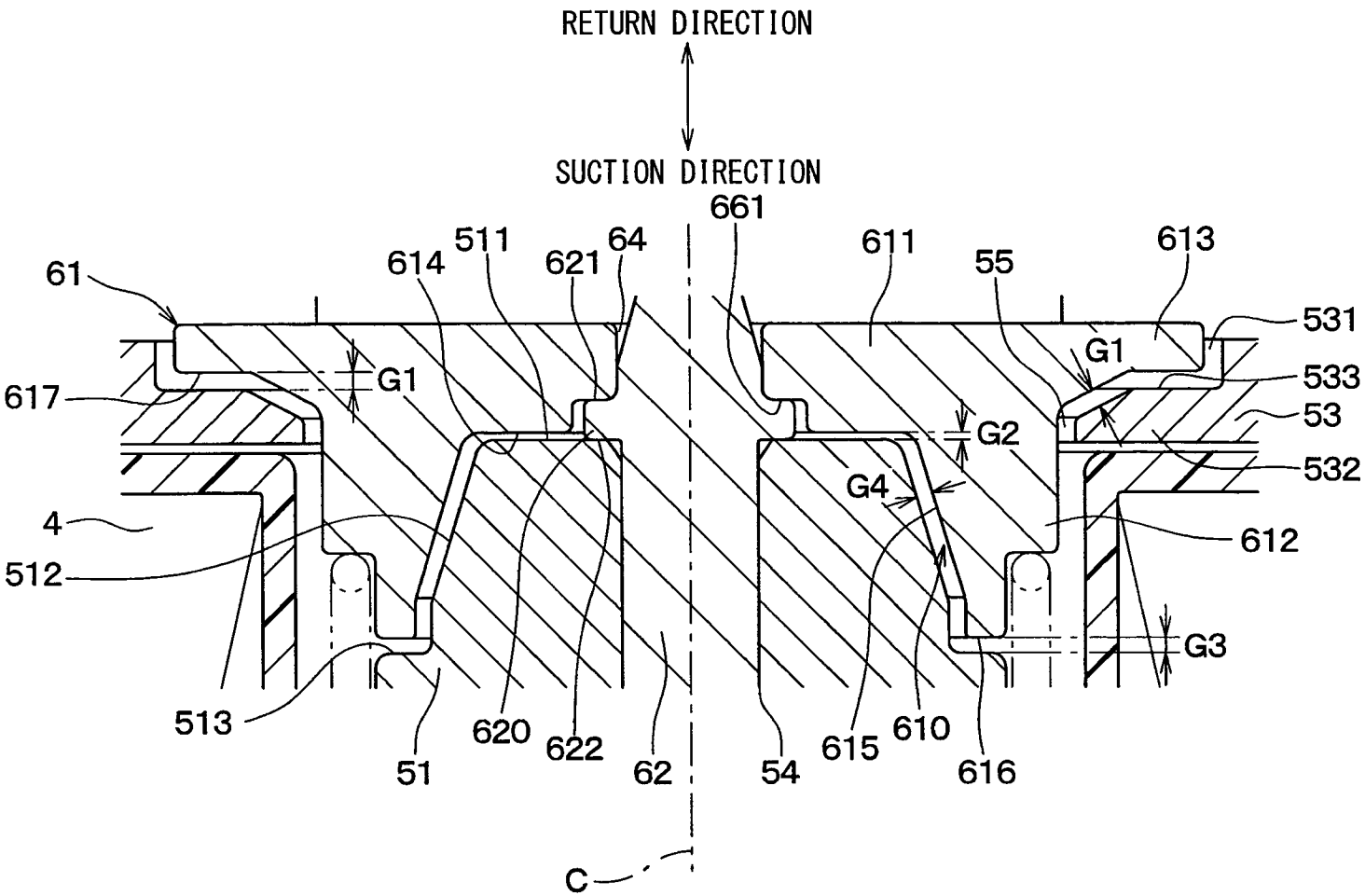
FIG. 4 is a schematic sectional view according to a third embodiment.

As shown in FIG. 4, when the movable core 61 is provided with the movable side recess portion 661, the fixed side recess portion 514 shown in FIGS. 2 and 3 may be omitted. In that case, the separation distances in the first to fourth magnetic gaps G1 to G4 are defined by the thickness of the shaft flange portion 620 and the depth of the movable side recess portion 661 in the movable core 61. The facing area in the second magnetic gap G2 is defined by an outer diameter of the shaft flange portion 620, that is, a size in the coil radial direction of the movable side recess portion 661 for housing the shaft flange portion 620.

Fourth Embodiment

Figure 5:
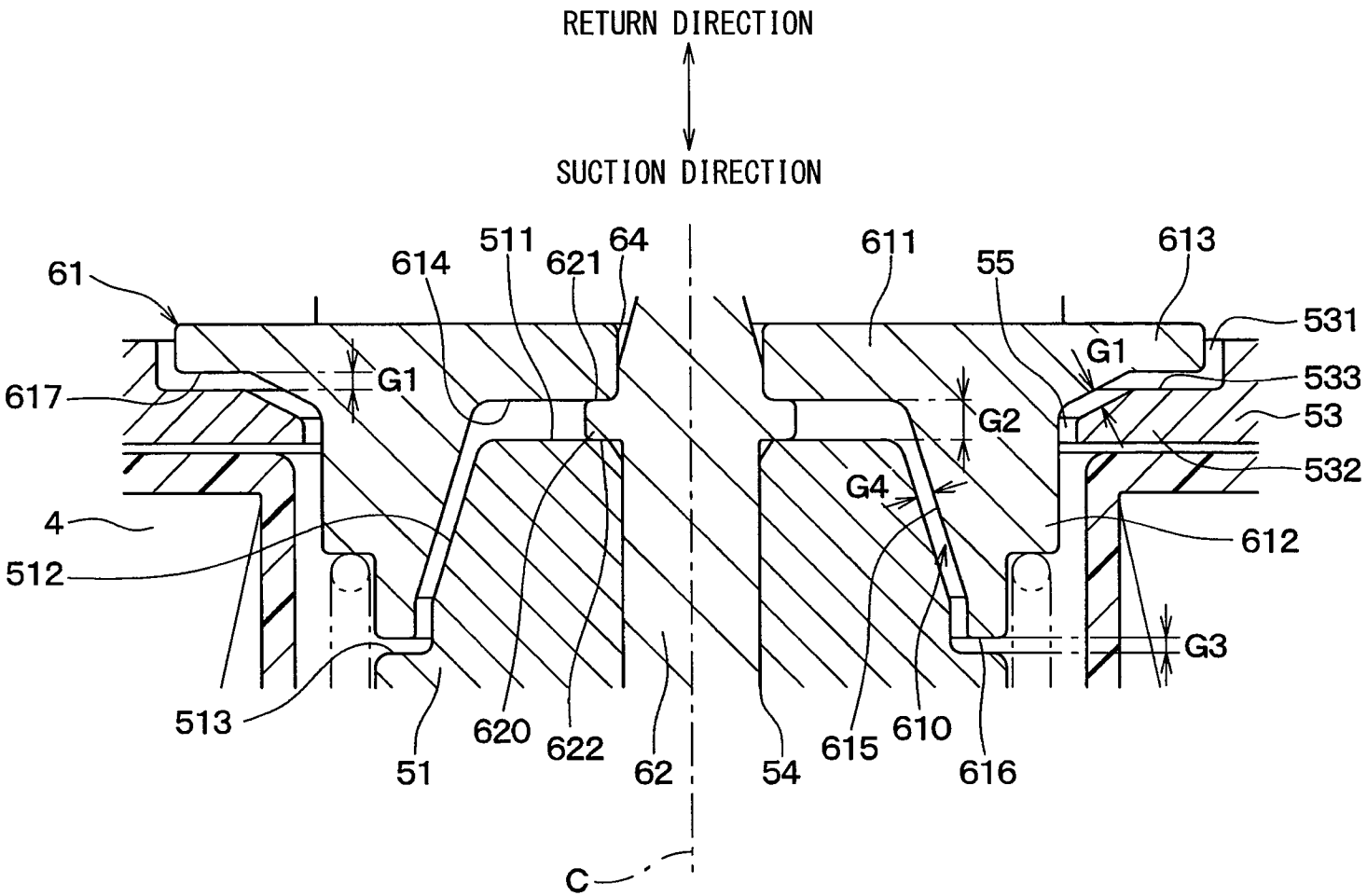
FIG. 5 is a schematic sectional view according to a fourth embodiment.

As shown in FIG. 5, both a fixed side recess portion 514 in a fixed core 51 and a movable side recess portion 661 in a movable core 61 may be omitted. Such a configuration can also provide the same effects as those of the embodiments described above.

Fifth Embodiment

In each of the embodiments described above, the fixed core 51 is provided with the male tapered portion 510 protruding toward the movable core 61. On the other hand, the movable core 61 is provided with the female tapered portion 610 so as to cover the male tapered portion 510 when the coil 4 is energized. In other words, in each of the embodiments described above, when the coil 4 is energized, a relative movement between the fixed core 51 and the movable core 61 is performed in such a manner that the male tapered portion 510, which is a tip portion of the fixed core 51, is inserted into the recess portion provided inside the female tapered portion 610 of the movable core 61. Further, the reciprocating movement of the shaft 62 is guided by the fixed core 51.

On the other hand, the configurations of the fixed core 51 and the movable core 61 according to the fifth embodiment are different from those of the embodiments described above, and the relative movement between the fixed core 51 and the movable core 61 is performed in such a manner that the tip portion of the movable core 61 is inserted into the recess portion provided in the fixed core 51 when the coil 4 is energized. The reciprocating movement of the movable core 61 and the shaft 62 is guided by the plate yoke 53.

Figure 6:
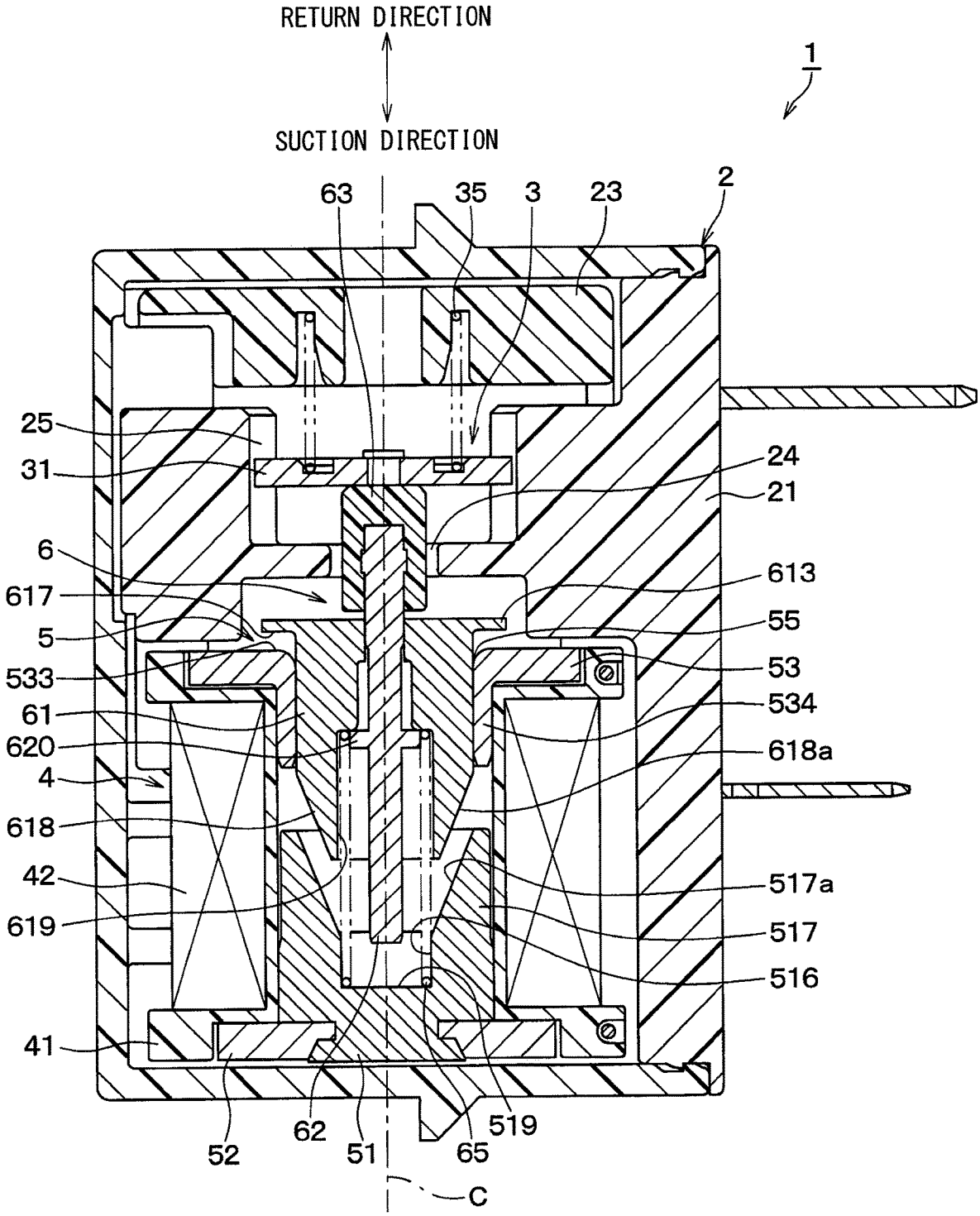
FIG. 6 is a schematic sectional view according to a fifth embodiment.
Figure 7:
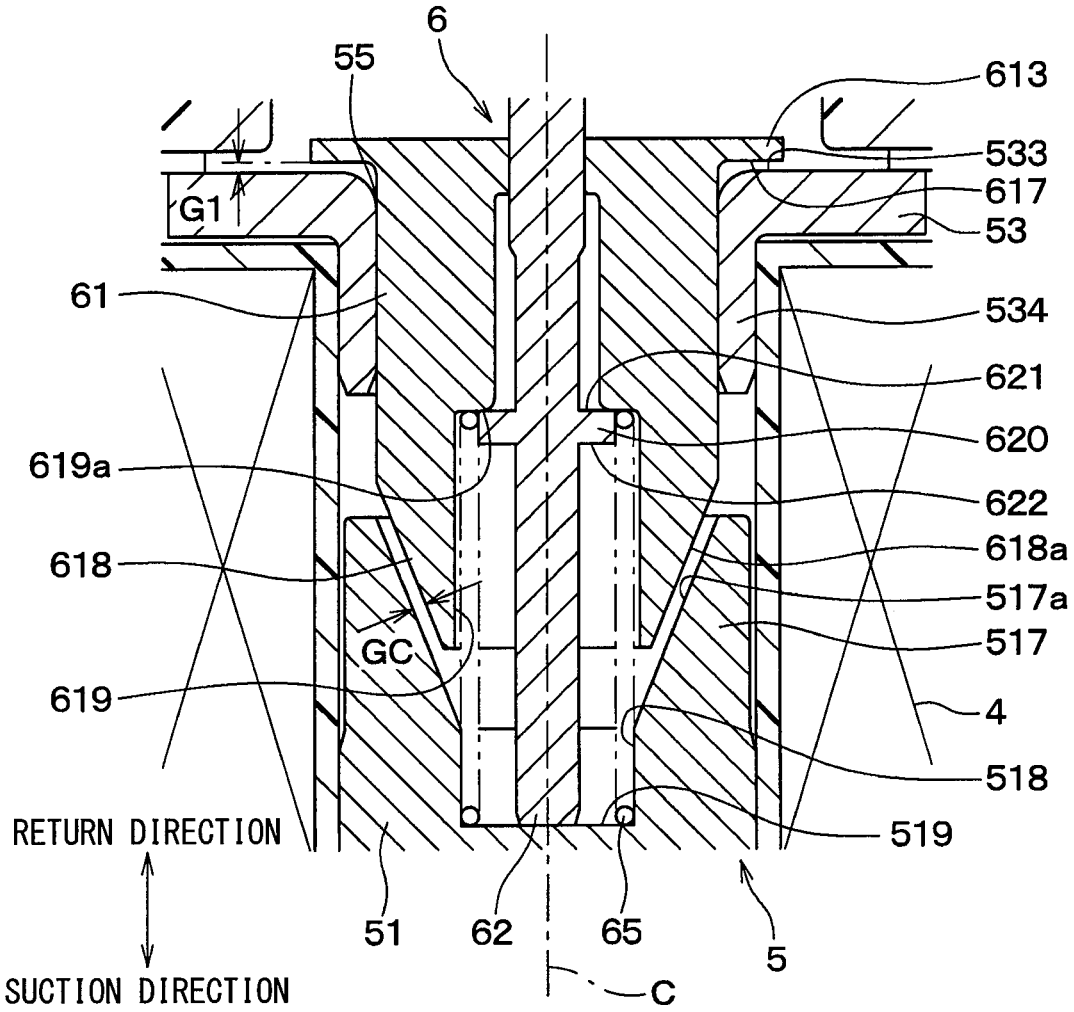
FIG. 7 is an enlarged view illustrating a part of FIG. 6.

More specifically, referring to FIGS. 6 and 7, according to the fifth embodiment, the fixed core 51 is provided with a female tapered portion 517 that configures a recess portion that opens toward the return direction. The female tapered portion 517 has a tapered inner surface 517*a* that increases in diameter toward the return direction. A cylindrical recess portion 518 is connected to an end portion of the tapered inner surface 517 on the suction direction side. The cylindrical recess portion 518 is formed along the center axis line C so as to open toward the return direction. A bottom surface 519, which is a plane perpendicular to the center axis line C, is formed at the end portion of the cylindrical recess portion 518 on the suction direction side. The bottom surface 519 is provided so that the tip end face of the shaft 62 abuts against the bottom surface 519 when the coil 4 is energized.

The plate yoke 53 has a guide cylinder portion 534. The guide cylinder portion 534 is a substantially circular tubular portion projecting toward the suction direction, and a core passage hole 55 is provided on an inner peripheral surface of the guide cylinder portion 534. The core passage hole 55 is formed in a cylindrical inner surface shape along the center axis line C so as to guide the reciprocating movement of the movable core 61 by sliding with the outer cylindrical surface of the movable core 61 on the return direction side of the male tapered portion 618.

Also in the fifth embodiment, the core flange portion 613 is provided at the end portion of the movable core 61 on the return direction side, that is, at the end portion on the opposite side to the side close to the fixed core 51. The movable core 61 is provided with a male tapered portion 618 projecting toward the fixed core 51. The male tapered portion 618 has a tapered outer surface 618*a* whose diameter decreases toward the suction direction.

A cylindrical recess portion 619 that opens in the suction direction is formed inside the movable core 61. A recess portion top surface 619*a*, which is a ring-shaped plane perpendicular to the center axis line C, is formed at the end portion of the cylindrical recess portion 619 on the return direction side. The recess portion top surface 619*a* is provided so as to abut against the first flange surface 621 of the shaft flange portion 620 when the movable core 61 and the shaft 62 are assembled together. A return spring 65 is disposed between the recess portion top surface 619*a* and the bottom surface 519 of the fixed core 51.

In the configuration described above, when the coil 4 is energized, the movable core 61 is attracted to the fixed core 51, so that the movable core 61 and the shaft 62 move in the suction direction. At that time, the tip end face of the shaft 62 abuts against the bottom surface 519 of the fixed core 51. As a result, a positional relationship between the fixed core 51 and the movable core 61 and a positional relationship between the plate yoke 53 and the movable core 61 when the coil 4 is energized are defined.

More particularly, referring to FIG. 7, the first magnetic gap G1 is defined between the yoke surface 533 of the plate yoke 53 and the core flange surface 617 of the movable core 61 in a state in which the tip end face of the shaft 62 abuts against the bottom surface 519 of the fixed core 51. An inter-core magnetic gap GC is defined between the tapered inner surface 517*a* of the fixed core 51 and the tapered outer surface 618*a* of the movable core 61.

According to the present embodiment, the first magnetic gap G1 and the inter-core magnetic gap GC vary in accordance with the formation state of the shaft flange portion 620 in the shaft 62, that is, the separation distance in the direction parallel to the center axis line C from the tip end face of the shaft 62 to the first flange surface 621. In addition, the first magnetic gap G1 varies in accordance with the thickness of the core flange portion 613, that is, the separation distance in the direction parallel to the center axis line C from the tip end face of the shaft 62 to the core flange surface 617.

According to the configuration described above, the separation distances in the first magnetic gap G1 and the inter-core magnetic gap GC can be adjusted by appropriately adjusting the shapes of the core flange portion 613 and the shaft 62. Therefore, according to the present embodiment, the operation voltage in the electromagnetic relay 1 can be easily adjusted. In addition, the degree of freedom in design of the electromagnetic relay 1 is improved.

OTHER MODIFICATIONS

The present disclosure is not limited to the specific examples described in the above embodiments. In other words, the respective embodiments described above can be appropriately changed.

For example, in the configuration of FIGS. 1 to 5, the yoke recess portion 531 and the core flange portion 613 may be omitted.

In the fifth embodiment shown in FIGS. 6 and 7, the end portion of the movable core 61 on the suction direction side may be formed in the same shape as that of the male tapered portion 510 shown in FIGS. 1 to 5. In that case, the end portion of the fixed core 51 on the return direction side is formed in the same shape as that of the female tapered portion 610 shown in FIGS. 1 to 5. In other words, in the fifth embodiment shown in FIG. 6, the portion where the fixed core 51 and the movable core 61 face each other can be formed in a structure inverted from the top to the bottom in FIGS. 2 to 5.

In the fifth embodiment shown in FIGS. 6 and 7, the yoke recess portion 531 similar to that in FIG. 2 or the like may be formed at a position of the plate yoke 53 facing the core flange portion 613. In that case, the thickness of the core flange portion 613 and the depth of the yoke recess portion 531 are appropriately set, thereby being capable of arbitrarily adjusting the separation distance in the magnetic gap between the movable core 61 and the fixed core 51.

In the above description, a member formed seamlessly and integrally may be configured to have a seam by bonding or the like between multiple members. Similarly, the multiple members provided separately from each other may be joined to each other seamlessly and integrally.

Modifications are also not limited to the above illustrations. Also, multiple modifications may be combined with each other. In addition, some of the configurations in each of the above embodiments and some of the configurations in each of the above modifications may be combined with each other.

According to the present disclosure, an electromagnetic relay includes:

a coil disposed to develop a magnetic field by energization;

a housing that supports the coil to fix;

a non-movable portion supported by the housing to fix, the non-movable portion including at least one fixed magnetic path defining member, to define a fixed magnetic path during the energization of the coil, having a fixed core disposed inside the coil; and a movable portion provided to be reciprocally movable along a center axis line of the coil according to an energization state of the coil, the movable portion including a movable core disposed to face the fixed core along the center axis line to be attracted by the fixed core by the magnetic field during the energization of the coil.

In the electromagnetic relay, one of a plurality of members configuring the movable portion integrally has a flange portion protruding in a coil radial direction perpendicular to the center axis line to define a separation distance and/or a facing area in a magnetic gap between the fixed magnetic path defining member and the movable core by abutting against the non-movable portion during the energization.

In the above configuration, the movable core is attracted to the fixed core by the magnetic field at the time of energization of the coil. As a result, the movable portion including the movable core moves along the center axis line of the coil toward the non-movable portion including the fixed core. At that time, the flange portion integrally provided with the one of the multiple members configuring the movable portion abuts against the non-movable portion. As a result, the separation distance and/or the facing area in the magnetic gap between the fixed magnetic path defining member and the movable core is defined. Therefore, according to the configuration described above, the adjustment of the separation distance and/or the facing area in the magnetic gap can be performed more excellently, compared with a comparative example in which a tip end face of a bearing for sliding a movable iron core rod is projected from an outer end face of a fixed iron core by a predetermined magnetic gap, so as to make it possible to provide a predetermined magnetic gap between the movable iron core and the fixed iron core without using a magnetic spacer, and also to easily perform fine adjustment of the magnetic gap.

The flange portion may be formed seamlessly and integrally with the one of the multiple members configuring the movable portion. In the configuration described above, the flange portion formed seamlessly and integrally with the one of the multiple members configuring the movable portion abuts against the non-movable portion, thereby defining the separation distance and/or the facing area in the magnetic gap. Therefore, according to the configuration described above, the separation distance and/or the facing area in the magnetic gap can be defined with more excellent accuracy.

The non-movable portion may further include a plate yoke as the fixed magnetic path defining member disposed between the fixed core and the movable core. In this case, the flange portion is provided to define the separation distance and/or the facing area in the magnetic gap between the movable core and the fixed core or the magnetic gap between the movable core and the plate yoke.

The movable portion may further include a shaft fixed to the movable core and provided along the center axis line. In this case, the flange portion is provided on the shaft to abut against the fixed core during the energization.

The fixed core may have a fixed side recess portion opening toward the flange portion. In this case, the flange portion is configured to be located inside the fixed side recess portion while abutting against the fixed core.

The movable core may have a movable side recess portion opening toward the flange portion. In this case, the shaft is fixed to the movable core in a state where the flange portion is located inside the movable side recess portion.

The flange portion may be provided on the movable core to define the separation distance in the magnetic gap between the movable core and the fixed core by abutting against the plate yoke during the energization.

What is claimed is:

1. An electromagnetic relay comprising:

a coil disposed to develop a magnetic field by energization;

a housing that supports the coil to fix;

a non-movable portion supported by the housing to fix, the non-movable portion including at least one fixed magnetic path defining member, to define a fixed magnetic path during the energization of the coil, having a fixed core disposed inside the coil; and a movable portion provided to be reciprocally movable along a center axis line of the coil according to an energization state of the coil, the movable portion including a movable core disposed to face the fixed core along the center axis line to be attracted by the fixed core by the magnetic field during the energization of the coil;

wherein:

one of a plurality of members configuring the movable portion integrally has a flange portion protruding in a coil radial direction perpendicular to the center axis line to define a separation distance and/or a facing area in at least one magnetic gap between the fixed magnetic path defining member and the movable core by abutting against the non-movable portion during the energization; and when the flange portion is in contact with the non-movable portion, the at least one magnetic gap between the fixed magnetic path defining member and the movable core includes (i) a first magnetic gap defined between a yoke surface of a plate yoke of the non-movable portion and a core flange surface of the movable core and (ii) a second magnetic gap defined between a core top surface of the fixed core and a flange abutment surface of the movable core.

2. The electromagnetic relay according to claim 1, wherein the flange portion is formed seamlessly and integrally with the one of the plurality of members configuring the movable portion.

3. The electromagnetic relay according to claim 1, wherein the non-movable portion further includes a plate yoke as the fixed magnetic path defining member disposed between the fixed core and the movable core, and the flange portion is provided to define the separation distance and/or the facing area in the at least one magnetic gap between the movable core and the fixed core or between the movable core and the plate yoke.

4. The electromagnetic relay according to claim 3, wherein the flange portion is provided on the movable core to define the separation distance in the magnetic gap between the movable core and the fixed core by abutting against the plate yoke during the energization.

5. The electromagnetic relay according to claim 1, wherein the movable portion further includes a shaft fixed to the movable core and provided along the center axis line, and the flange portion is provided on the shaft to abut against the fixed core during the energization.

6. The electromagnetic relay according to claim 5, wherein the fixed core has a fixed side recess portion opening toward the flange portion, and the flange portion is configured to be located inside the fixed side recess portion while abutting against the fixed core.

7. The electromagnetic relay according to claim 5, wherein the movable core has a movable side recess portion opening toward the flange portion, and the shaft is fixed to the movable core in a state where the flange portion is located inside the movable side recess portion.

8. The electromagnetic relay according to claim 1, wherein:

a third magnetic gap is defined between a step surface of the fixed core and a protrusion surface of the movable core; and a fourth magnetic gap is defined between a tapered outer surface of the fixed core and a tapered inner surface of the movable core.

9. An electromagnetic relay comprising:

a coil configured to generate a magnetic field when energized;

a housing that supports the coil;

a non-movable portion supported by the housing and including a fixed core, a frame yoke, and a plate yoke that form a fixed magnetic path during energization of the coil;

a movable portion configured to reciprocally move along a center axis line of the coil based on an energization state of the coil, the movable portion including a movable core that faces the fixed core and the plate yoke and is attracted to the fixed core and the plate yoke by the magnetic field during the energization of the coil, the movable core including a shaft having a flange portion protruding in a coil radial direction perpendicular to the center axis line, the flange portion abutting against the fixed core of the non-movable portion during energization of the coil;

wherein:

when the flange portion abuts against the fixed core of the non-movable portion during energization of the coil, a first magnetic gap is formed between a yoke surface of the plate yoke of the non-movable portion and a core flange surface of the movable core, and a second magnetic gap is formed between a core top surface of the fixed core and a flange abutment surface of the movable core.

10. The electromagnetic relay according to claim 9, wherein:

when the flange portion abuts against the fixed core of the non-movable portion during energization of the coil, a third magnetic gap is formed between a step surface of the fixed core and a protrusion surface of the movable core, and a fourth magnetic gap is formed between a tapered outer surface of the fixed core and a tapered inner surface of the movable core.

11. The electromagnetic relay according to claim 10, wherein the fixed core includes a fixed side recess portion opening toward the flange portion, and the flange portion is configured to be located inside the fixed side recess portion while abutting against the fixed core of the non-movable portion during energization of the coil.

* * * * *